US007066332B2

(12) United States Patent
Kobayashi et al.

(10) Patent No.: US 7,066,332 B2
(45) Date of Patent: Jun. 27, 2006

(54) FOLDABLE ACCOMMODATING BOX

(75) Inventors: Shigeru Kobayashi, Sayama (JP); Masahiro Katayama, Sayama (JP); Kiyoshi Kasuya, Sayama (JP)

(73) Assignees: Honda Giken Kogyo Kabushiki Kaisha, Tokyo (JP); Komyo Co., Ltd., Saitama (JP)

( * ) Notice: Subject to any disclaimer, the term of this patent is extended or adjusted under 35 U.S.C. 154(b) by 305 days.

(21) Appl. No.: 10/668,762

(22) Filed: Sep. 23, 2003

(65) Prior Publication Data

US 2005/0230283 A1 Oct. 20, 2005

(30) Foreign Application Priority Data

Sep. 24, 2002 (JP) ..... 2002-277222

(51) Int. Cl.
*B65D 19/12* (2006.01)

(52) U.S. Cl. ..... 206/600; 220/4.28; 220/4.31; 220/6

(58) Field of Classification Search ..... 206/600, 206/386; 220/4.28, 4.29, 4.31, 4.32, 4.33, 220/6, 7; 108/53.1, 56.1, 56.3, 57.14
See application file for complete search history.

(56) References Cited

FOREIGN PATENT DOCUMENTS

| | | |
|---|---|---|
| JP | 2562035 | 10/1997 |
| JP | 2580423 | 6/1998 |

*Primary Examiner*—Mickey Yu
*Assistant Examiner*—Jerrold Johnson
(74) *Attorney, Agent, or Firm*—Standley Law Group LLP

(57) ABSTRACT

A foldable accommodating box includes a floor having a sidewall accommodating pocket, a pair of end walls pivotally supported on the floor, and a pair of sidewalls capable of being accommodated in the sidewall accommodating pocket in a mutually piled state. Each of the sidewalls includes a wall plate formed into a right-angled quadrilateral shape, a frame plate secured at right angles to an outer surface of an outer periphery of the wall plate, and a plurality of metal bars combined in a lattice shape and secured to the wall plate and the frame plate. The frame plate is provided with a notch for ensuring that when the sidewalls are piled on each other in an embraced manner so that their outer surfaces are opposed to each other, they are piled on each other with the frame plates partially adjoining each other on inner and outer sides. Thus, it is possible to prevent a portion of an accommodated member from protruding, and the sidewall can be constructed to have a sufficient strength, while avoiding an increase in weight. Moreover, it is possible to prevent an increase in thickness of the pair of sidewalls.

2 Claims, 16 Drawing Sheets

FOLDABLE ACCOMMODATING BOX

BACKGROUND OF THE INVENTION

1. Field of the Invention

The present invention relates to a foldable accommodating box comprising a floor which includes a pair of parallel frames each forming a fork pocket and connected to each other, and a sidewall accommodating pocket formed between the frames, a pair of end walls pivotally supported on the floor for turning movement between a folded-up position in which they are piled on the floor and an upright position in which they stand up from the floor, and a pair of sidewalls capable of being accommodated in the sidewall accommodating pocket in a mutually piled state, so that when the accommodating box has been assembled, the pair of end walls opposed to each other and the pair of sidewalls opposed to each other perpendicularly to the end walls are provided to rise on the floor to form a rectangular parallelepiped shape.

2. Description of the Related Art

Such a foldable accommodating box is conventionally known, for example, from the following publications: Japanese Utility Model Publication No. 2562035 and Japanese Utility Model Publication No. 2580423. In this foldable accommodating box, a lattice section made by combining a plurality of bars with one another is connected to frames forming upper portions of the sidewalls, whereby the sidewalls are constructed.

In the construction of the sidewalls in the conventionally known foldable accommodating box, there is a possibility that a portion of an accommodated member protrudes to the outside from a clearance in the lattice section, and it is desired strongly to increase the strength. It is easy to construct the sidewalls from such viewpoint, but in this case, it is necessary to suppress an increase in weight of the sidewall to the utmost. Moreover, both the sidewalls are piled on each other and accommodated in the sidewall accommodating pocket, and it is also necessary to suppress increases in thickness of both the sidewalls in the piled states.

SUMMARY OF THE INVENTION

Accordingly, it is an object of the present invention to provide a foldable accommodating box, wherein sidewalls are constructed so that a portion of an accommodated member is prevented from protruding, and so that it has a sufficient strength, while avoiding an increase in weight, and moreover, the thickness of the pair of sidewalls piled on each other can be prevented from being increased.

To achieve the above object, according to a first aspect and feature of the present invention, there is provided a foldable accommodating box comprising a floor which includes a pair of parallel frames each forming a fork pocket and connected to each other, and a sidewall accommodating pocket formed between the frames, a pair of end walls pivotally supported on the floor for turning movement between a folded-up position in which they are piled on the floor and an upright position in which they stand up from the floor, and a pair of sidewalls capable of being accommodated in the sidewall accommodating pocket in a mutually piled state, so that when the accommodating box has been assembled, the pair of end walls opposed to each other and the pair of sidewalls opposed to each other perpendicularly to the end walls are provided to rise on the floor to form a rectangular parallelepiped shape, wherein each of the sidewalls includes a wall plate formed from a metal plate into a right-angled quadrilateral shape, a frame plate formed from a metal plate into a right-angled quadrilateral piped shape and secured at right angles to an outer surface of an outer periphery of the wall plate, and a plurality of metal bars which are secured to one another and combined into a lattice shape and which are secured to the wall plate and the frame plate on the side of the outer surface of the wall plate, the frame plate being provided notches ensuring that when the sidewalls are piled on each other in an embraced manner so that their outer surface are opposed to each other, they are piled on each other with the frame plates partially adjoining each other on inner and outer sides.

With such arrangement of the first feature, it is possible to reliably prevent a portion of an accommodated member from protruding from the sidewall by constructing most of the sidewall by the wall plate. In addition, even if the thickness of the wall plate is set at a small value to the utmost, the wall plate can be reinforced by the frame plate and the plurality of metal bars and hence, it is possible to provide the sidewall with a sufficient strength, while avoiding an increase in weight of the sidewall. Moreover, the provision of the notches in the frame plate ensures that when the sidewalls are piled in the embraced manner on each other, so that their outer surfaces are opposed to each other, they are piled on each other with the frame plates partially adjoin each other. Therefore, it is possible to prevent the thickness of the sidewalls in the piled states from being increased.

According to a second aspect and feature of the present invention, in addition to the arrangement of the first feature, the floor includes end upper surface connecting members which each have a protruding wall opposed to a lower portion of the end wall in an upright state from outside and which connect upper surfaces of opposed ends of both the frames, and end lower surface connecting members which connect lower surfaces of the opposed ends of both the frames inside the protruding wall; the protruding wall having notches provided on opposite sides thereof for ensuring that when a plurality of the floors are stacked one on another with the end walls folded up, the ends of the frames of the overlying floor are disposed in the notches; and each of the end lower surface connecting members is projectingly provided with a limiting wall which is adapted to be opposed to the protruding wall of the underlying floor from inside, when the plurality of the floors are stacked one on another with the end walls folded up. With such arrangement, the notches are formed on the opposite sides of the protruding wall, and the end lower surface connecting members are inside the protruding walls of the end upper surface connecting members. Therefore, the floors with their end walls folded up can be stacked one on another, and when the accommodating box has been assembled, the protruding wall is opposed to the lower portion of the end wall from outside. Thus, it is possible to prevent the occurrence of the outward falling of the end wall. In addition, when the accommodating boxes in the folded states are stacked one on another, the limiting wall of the overlying accommodating box is opposed to the protruding wall of the underlying accommodating box from inside. Thus, it is possible to prevent the occurrence of offsetting of the accommodating boxes from each other in a lengthwise direction of the frames.

The above and other objects, features and advantages of the invention will become apparent from the following description of the preferred embodiment taken in conjunction with the accompanying drawings.

BRIEF DESCRIPTION OF THE DRAWINGS

FIGS. 1 to 16 show an embodiment of the present invention, wherein

FIG. 1 is a front view of an accommodating box in an assembled state;

FIG. 2 is a side view taken in a direction of an arrow 2 in FIG. 1;

FIG. 3 is a bottom view taken in a direction of an arrow 3 in FIG. 1;

FIG. 4 is an enlarged view taken in a direction of an arrow 4 in FIG. 1;

FIG. 5 is a view taken in a direction of an arrow 5 in FIG. 4;

FIG. 6 is a front view of an end wall;

FIG. 7 is an enlarged sectional view taken along a line 7—7 in FIG. 6;

FIG. 8 is a view similar to FIG. 5, but when the end wall is in the folded-up state;

FIG. 9 is a front view of a sidewall;

FIG. 10 is a view taken in a direction of an arrow 10 in FIG. 9;

FIG. 11 is an enlarged sectional view taken along a line 11—11 in FIG. 2 for explaining operations for bringing the sidewall into and out of engagement with the floor;

FIG. 12 is a side view of sidewalls in piled states;

FIG. 13 is a plan view of the sidewalls in piled states;

FIG. 14 is a plan view for explaining an operation for accommodating the piled sidewalls into the floor;

FIG. 15 is a front view of the accommodating box with the piled sidewalls accommodated in a sidewall accommodating pocket; and FIG. 16 is a front view of assembled accommodating boxes in a laminated state.

DESCRIPTION OF THE PREFERRED EMBODIMENT

The present invention will now be described by way of a preferred embodiment with reference to the accompanying drawings.

Figure 1:
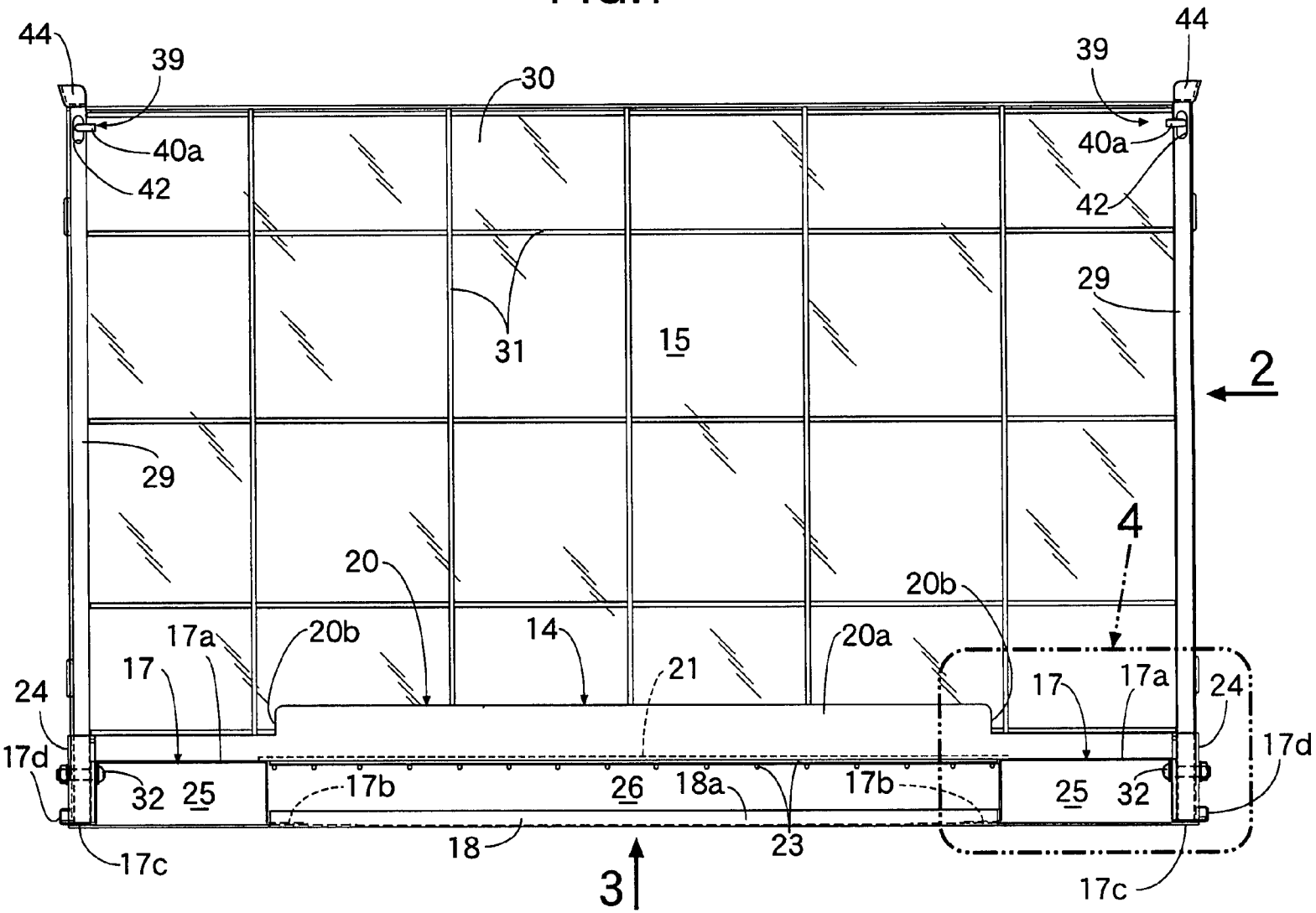
Figure 2:
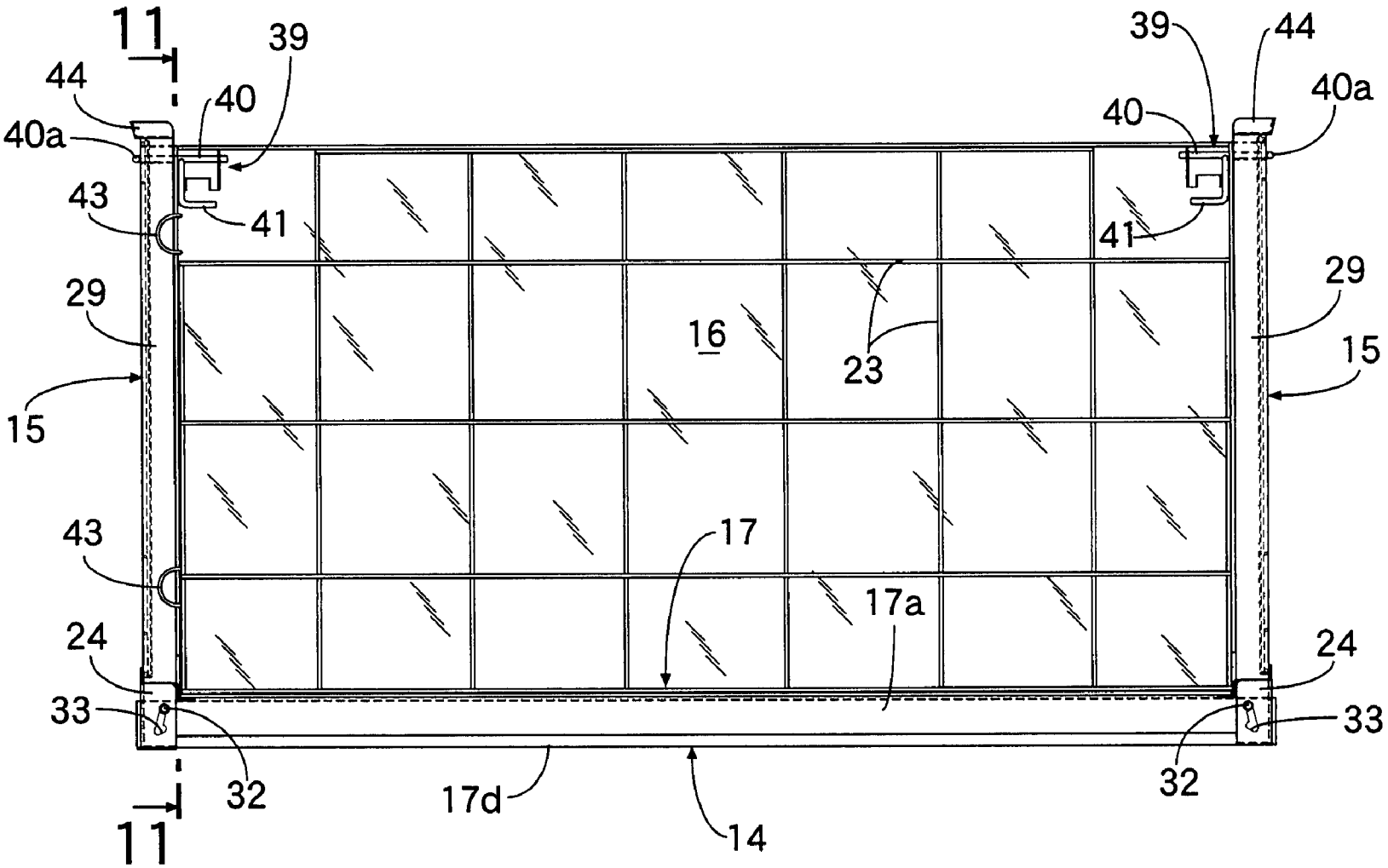
Figure 3:
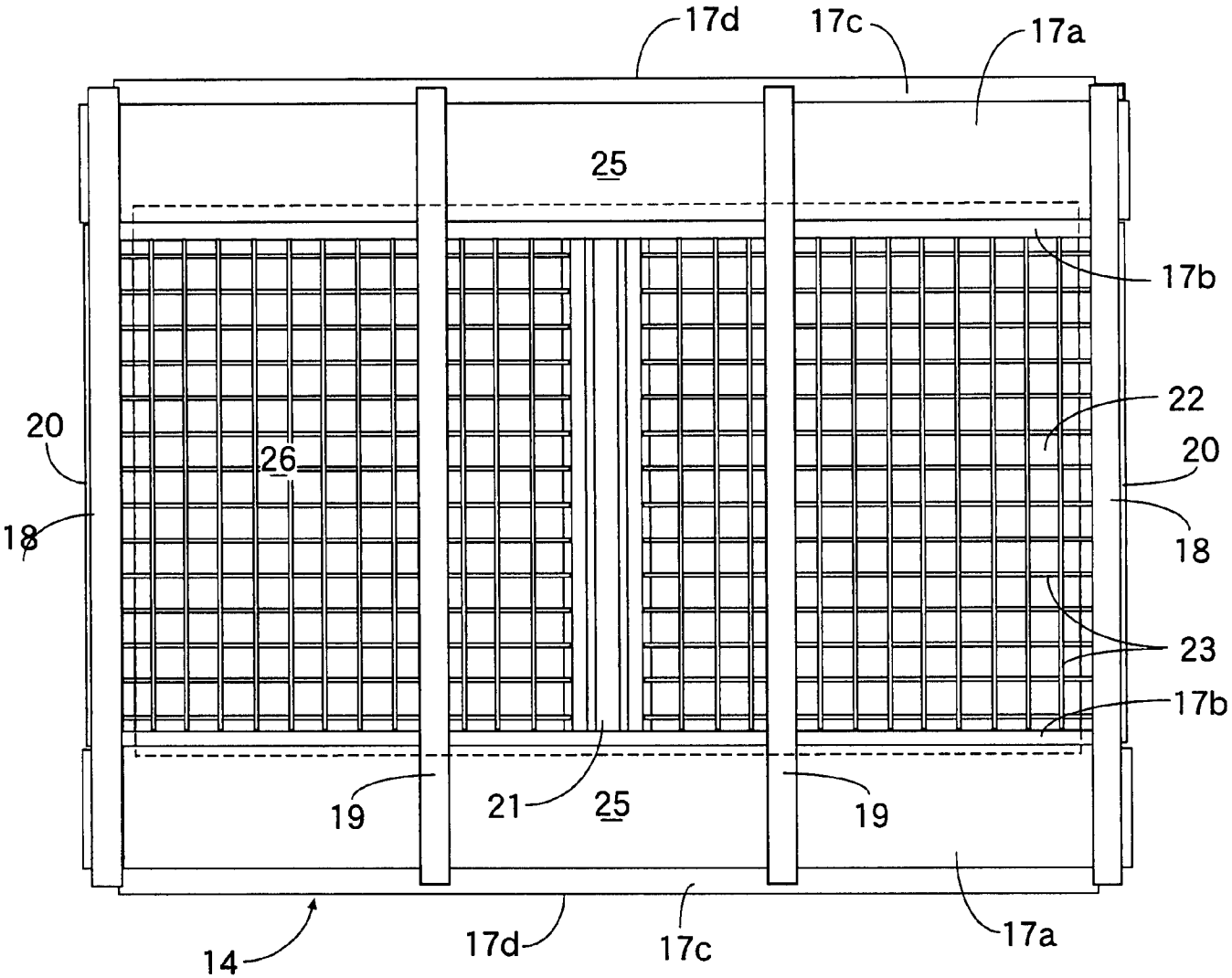

Referring first to FIGS. 1 to 3, an accommodating box is formed into a rectangular parallelepiped shape with its upper portion opened upon assembling thereof, and includes a floor 14, a pair of end walls 15, 15 and a pair of sidewalls 16, 16.

Figure 4:
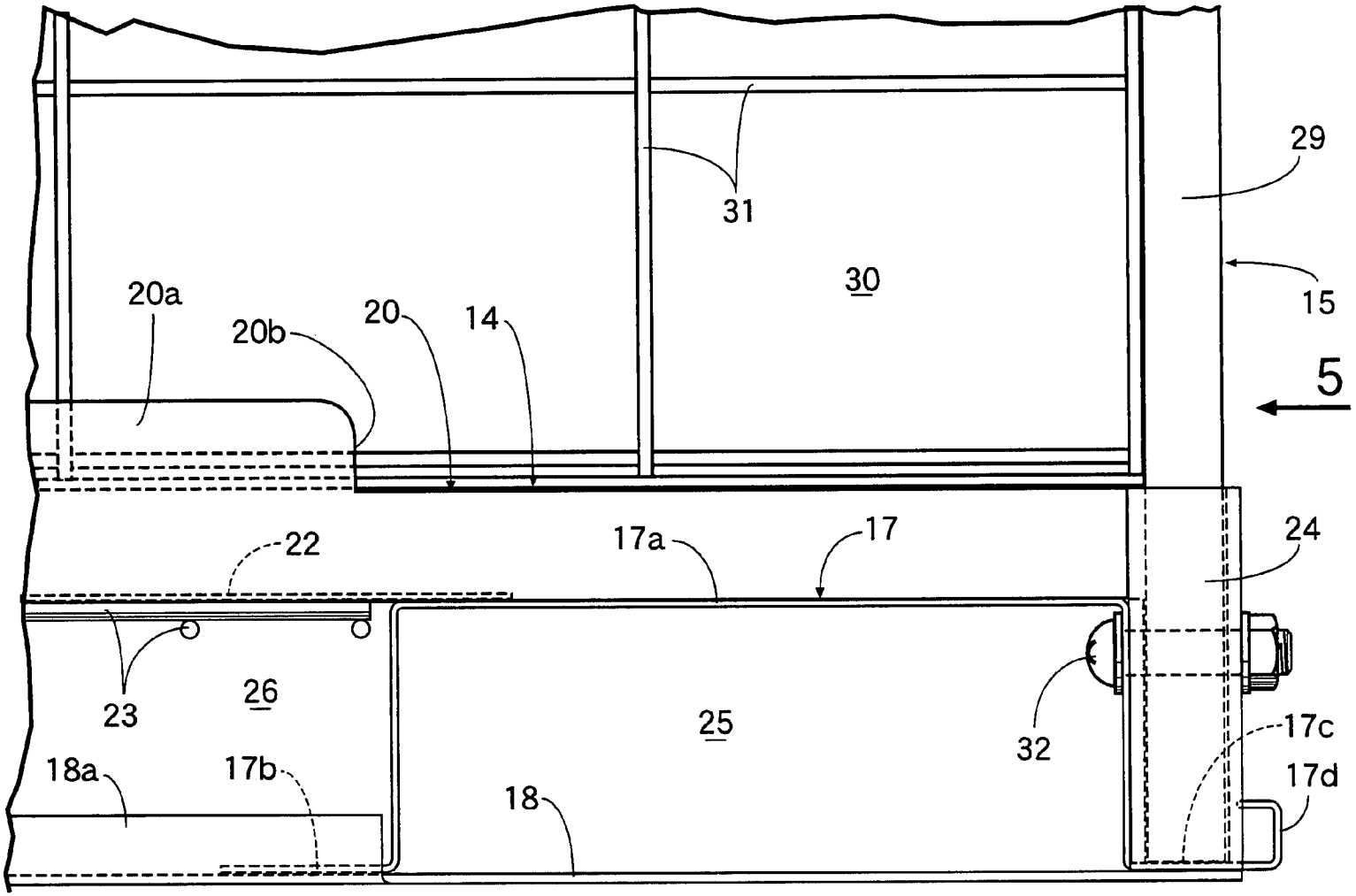

Referring also to FIG. 4, the floor 14 includes a pair of frames 17, 17 extending in parallel to each other, end lower surface-connecting members 18, 18 which connect lower surfaces of opposed ends of the frames 17, 17 to each other, a pair of intermediate portion lower surface-connecting members 19, 19 which connect lower surfaces of lengthwise intermediate portions of the frames 17, 17, end upper surface-connecting members 20, 20 which connect upper surfaces of the opposed ends of the frames 17, 17, an intermediate portion upper surface connecting member 21 which connects upper surfaces of the lengthwise intermediate portions of the frames 17, 17 to each other, a bottom plate 22 which connects the upper surface of the frames 17, 17, a plurality of metal bars 23, 23 which are secured to one another and combined in a lattice shape and which are secured to a lower surface of the bottom plate 22 at locations excluding the intermediate portion connecting member 21, and brackets 24 secured to outer sides of opposite ends of the frames 17, 17.

Each of the frames 17 is integrally provided with a main frame portion 17*a* which is formed to have a substantially U-shaped cross-sectional shape such that it opens downwards to form a fork pocket 25 for receiving a fork (not shown) when the accommodating box is to be lifted by a forklift or the like, an inner collar 17*b* extending inwards from an inner lower portion excluding the opposite ends of the main frame portion 17*a*, a outer collar 17*c* extending outwards from an outer lower portion excluding the opposite ends of the main frame portion 17*a*, and a locking portion 17*d* rising from a tip end of the outer collar 17*b*. The locking portion 17*d* is formed to have a substantially U-shaped cross-sectional shape such that it opens toward the main frame portion 17*a*.

A sidewall accommodating pocket 26 is defined between the frames 17, 17. The pair of piled-up sidewalls 16, 16 are accommodated in the sidewall accommodating pocket 26, and the sidewalls 16, 16 accommodated are supported on the end lower surface connecting members 18, 18 and the intermediate portion lower surface connecting plates 19, 19.

The end upper surface connecting members 20 each have a protruding wall 20*a* opposed to a lower portion of the end wall 15 in an upright state from outside, and connect the upper surfaces of the opposed ends of the frames 17, 17. The end lower surface connecting members 18 connects the lower surfaces of the opposed ends of the frames 17, 17 at locations inside the protruding walls 20*a*. Moreover, notches 20*b*, 20*b* are formed on opposite sides of each of the protruding walls 20*a*, so that when the plurality of floors 14 have been stacked one on another with the ends 15 folded up, the ends of the frames 17, 17 of the overlying floor 14 are disposed in the notches 20*b*, 20*b*. A limiting wall 18*a* is projectingly provided on each of the end lower surface connecting members 18 and adapted to be opposed to the protruding wall 20*a* of the underlying floor 14 from inside, when the plurality of floors 14 have been stacked one on another with the ends 15 folded up. Moreover, the limiting wall 18*a* also functions to prevent the sidewalls 16, 16 accommodated in the sidewall accommodating pocket 26 from being disadvantageously disengaged from the sidewall accommodating pocket 26.

The brackets 24 are each made of a die steel having a substantially U-shaped cross-sectional shape and secured to outer sides of the opposite ends of the frame 17, so that their sides opposed to each other are opened. An upper portion of each of the brackets 24 protrudes above upper portions of the frames 17.

Figure 5:
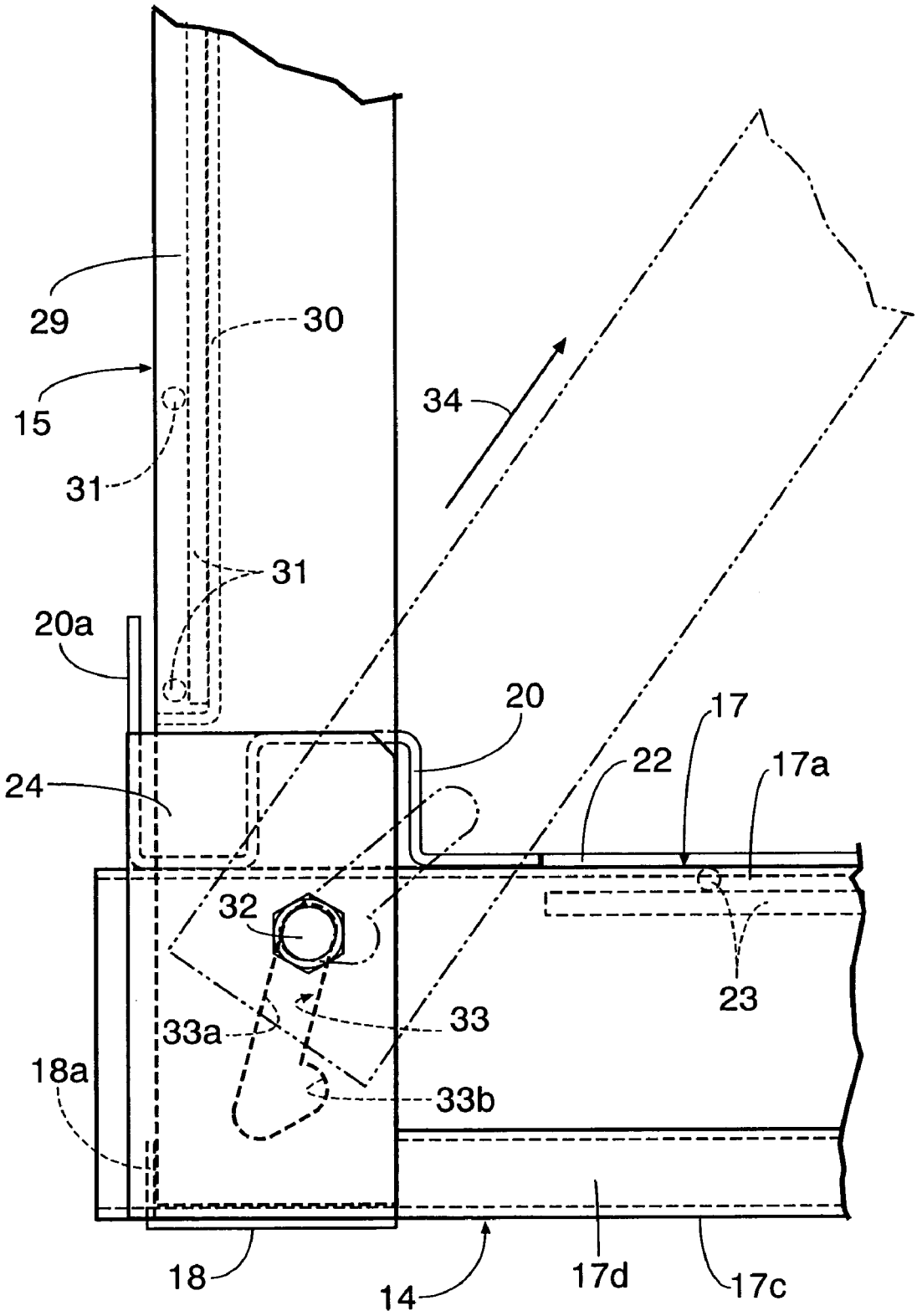
Figure 6:
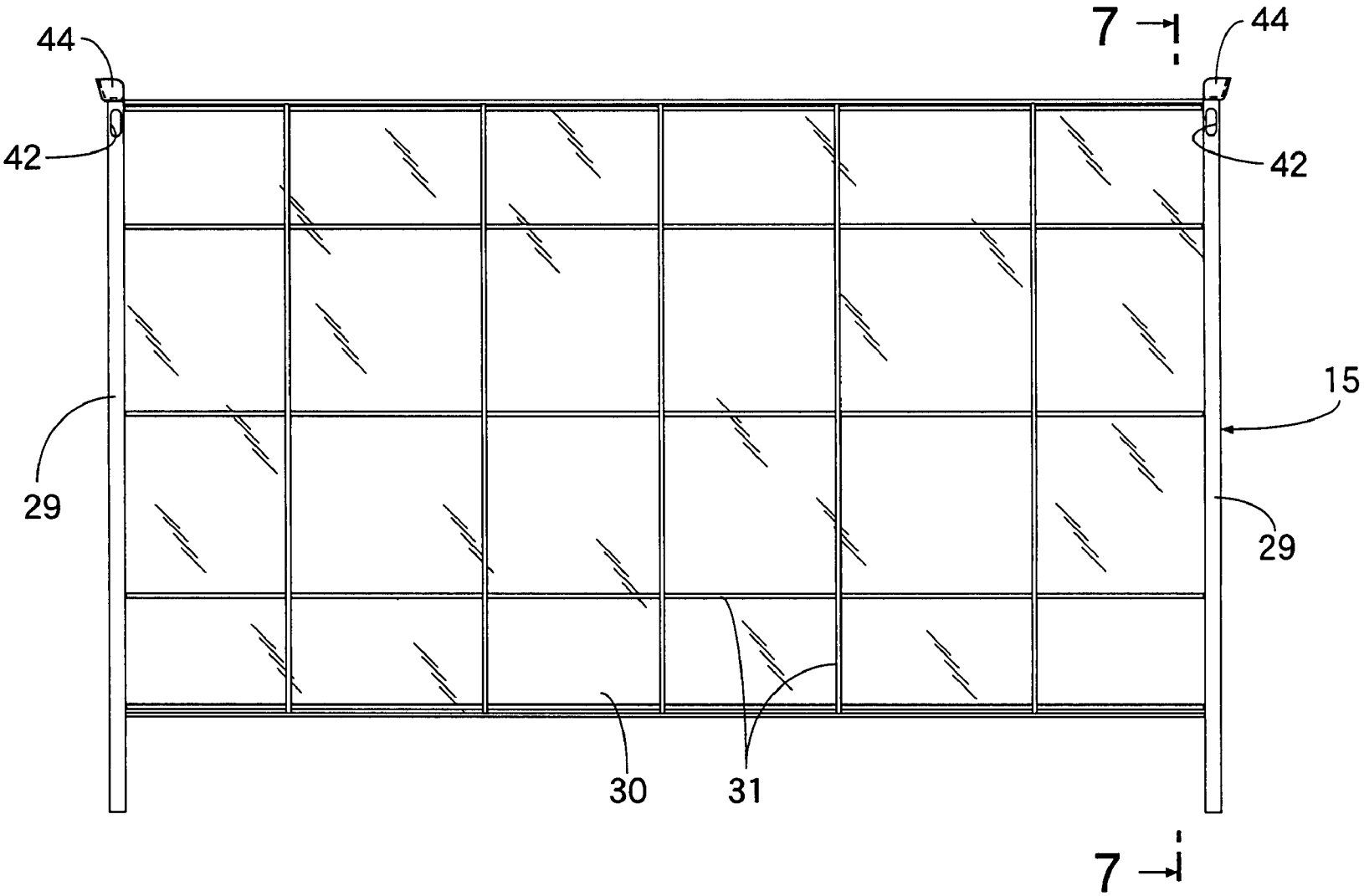
Figure 7:
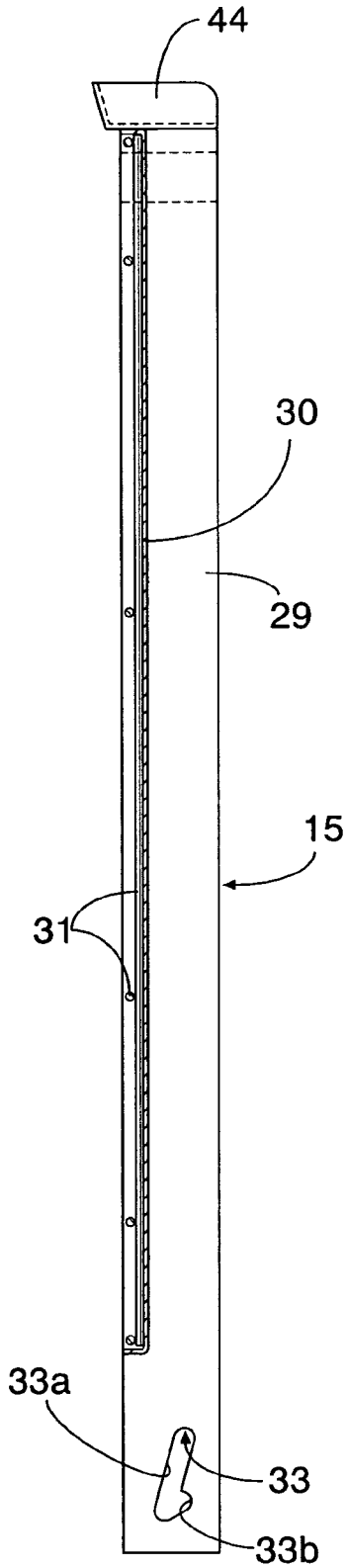

Referring also to FIGS. 5 to 7, the end wall 15 includes a pair of support columns 29, 29, an end plate 30 made of a metal plate material and secured to the support columns 29, 29, and a plurality of metal bar members 31 which are secured to one another and combined in a lattice shape and which are secured to an outer surface of the end plate 30.

The support columns 29, 29 are pivotally supported on the brackets 24, 24 of the floor 14, respectively, so that each of them can be turned between a folded-up position in which it is superposed on the floor 14 and an upright position in which it stands up from the floor 15. When each of the support columns 29, 29 has been folded up, it can be accommodated between the main frame portion 17*a* and the locking portion 17*d* of the floor 14. The end plate 30 is secured to the support columns 29, 29 at a location where it is avoided that the end plate 30 interferes with the floor 14 when the end wall 15 is in the upright position.

Figure 8:
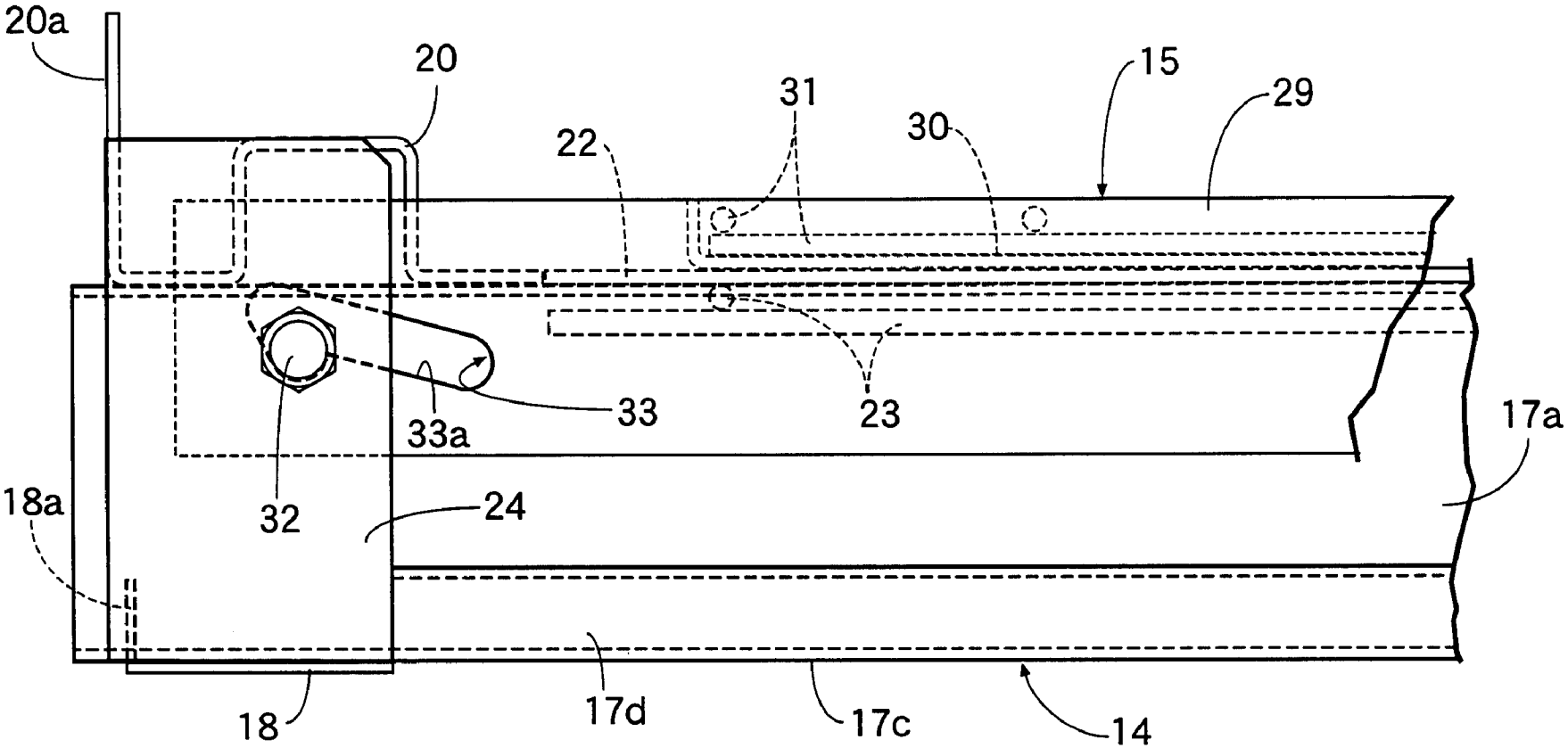

Support shafts 32 are fixed to the brackets 24 of the floor 14 and inserted through support bores 33 provided in lower ends of the support columns 29. Each of the support bores 33 includes an elongated bore portion 33*a* which is formed so that when the end wall 15 is in the upright position, the support shaft 32 is located at one end of the elongated bore portion 33*a*, and when the end wall 15 is turned to the upright position to the folded-up position, the support shaft 32 is located at the other end portion of the elongated bore portion 33*a* to form an axis for turning movement of the support column 29 in a state in which the support column 29 has been lifted up as shown by an arrow 34 in FIG. 5, and an engagement bore portion 33*b* which is connected to a lower end of the other end portion of the elongated bore portion 33*a* so that the support shaft 32 is positioned in place when the end wall 15 is in the folded-up position as shown in FIG. 8. The engagement bore portion 33*b* is formed to inhibit the movement of the end wall 15 in a horizontal direction on the floor 14 by engagement with the support shaft 33 when the end wall 15 is in the folded-up position.

Such end walls 15, 15 are formed to have such heights that they are superposed on the floor 14 on opposite sides of the intermediate portion upper surface connecting member 21 in their folded-up states.

Figure 9:
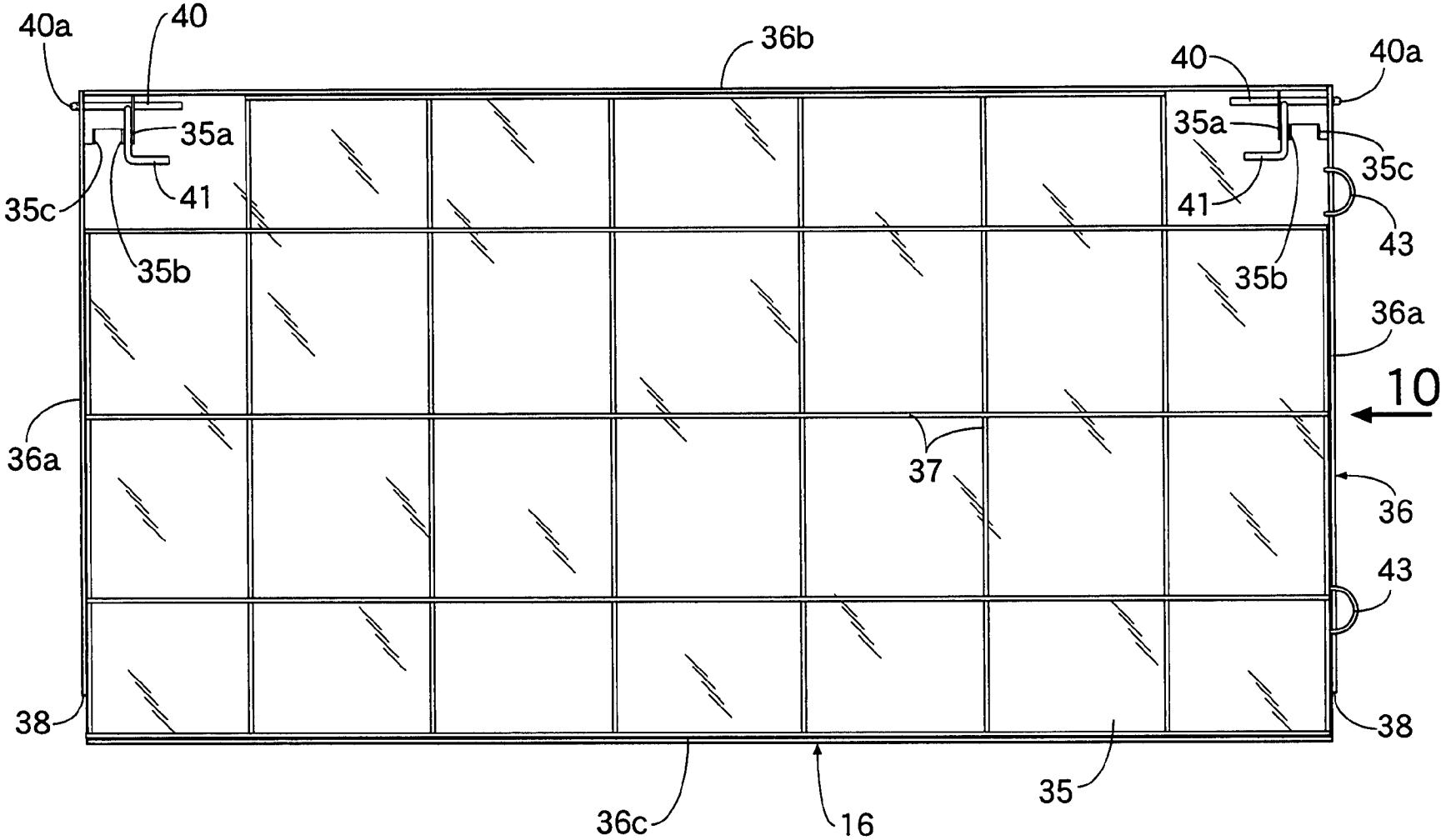
Figure 10:
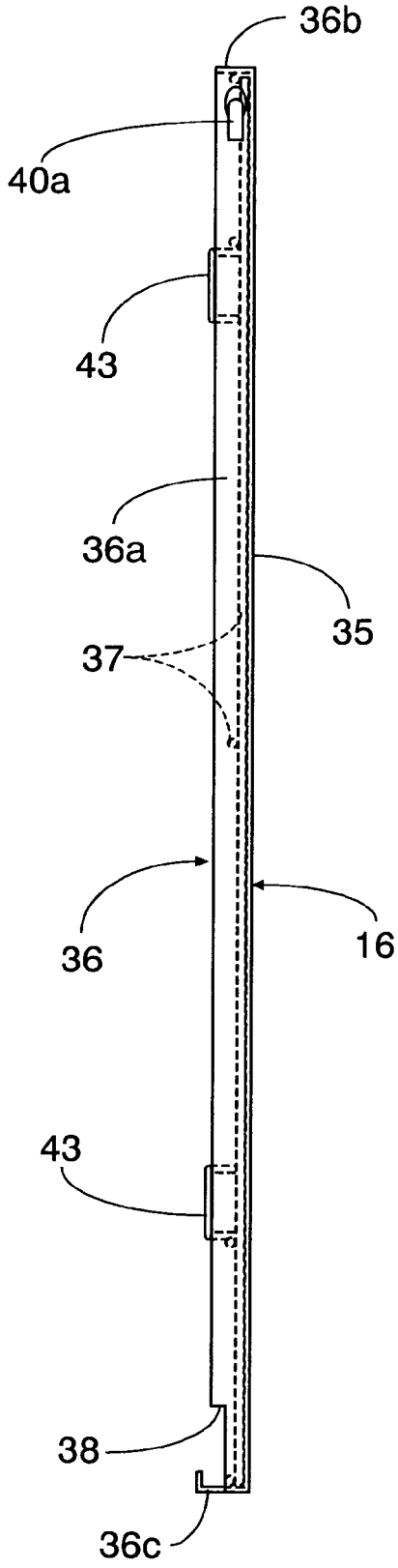

Referring to FIGS. 9 and 10, each of the sidewalls 16 includes a wall plate 35 formed from a metal plate into a right-angled quadrilateral shape, a frame plate 36 formed from a metal plate into a right-angled quadrilateral piped shape and secured at right angle to an outer surface of an outer periphery of the wall plate 35, and a plurality of metal bars 37 which are secured to one another and combined in a lattice shape and which are secured to the wall plate 35 and the frame plate 36 on the side of the outer surface of the wall plate 35.

The frame plate 36 includes a pair of longitudinal plate portions 36*a*, 36*a* extending in parallel to each other and secured to opposite sides of the wall plate 35, an upper transverse plate portion 36*b* secured to an upper portion of the wall plate 35 to connect upper portions of the longitudinal plate portions 36*a*, 36*a* to each other, and a lower transverse plate portion 36*c* secured to a lower portion of the wall plate 35 to connect lower portions of the longitudinal plate portions 36*a*, 36*a* to each other. Notches 38, 38 are provided at the lower portions of the longitudinal plate portions 36*a*, 36*a*.

Figure 11:
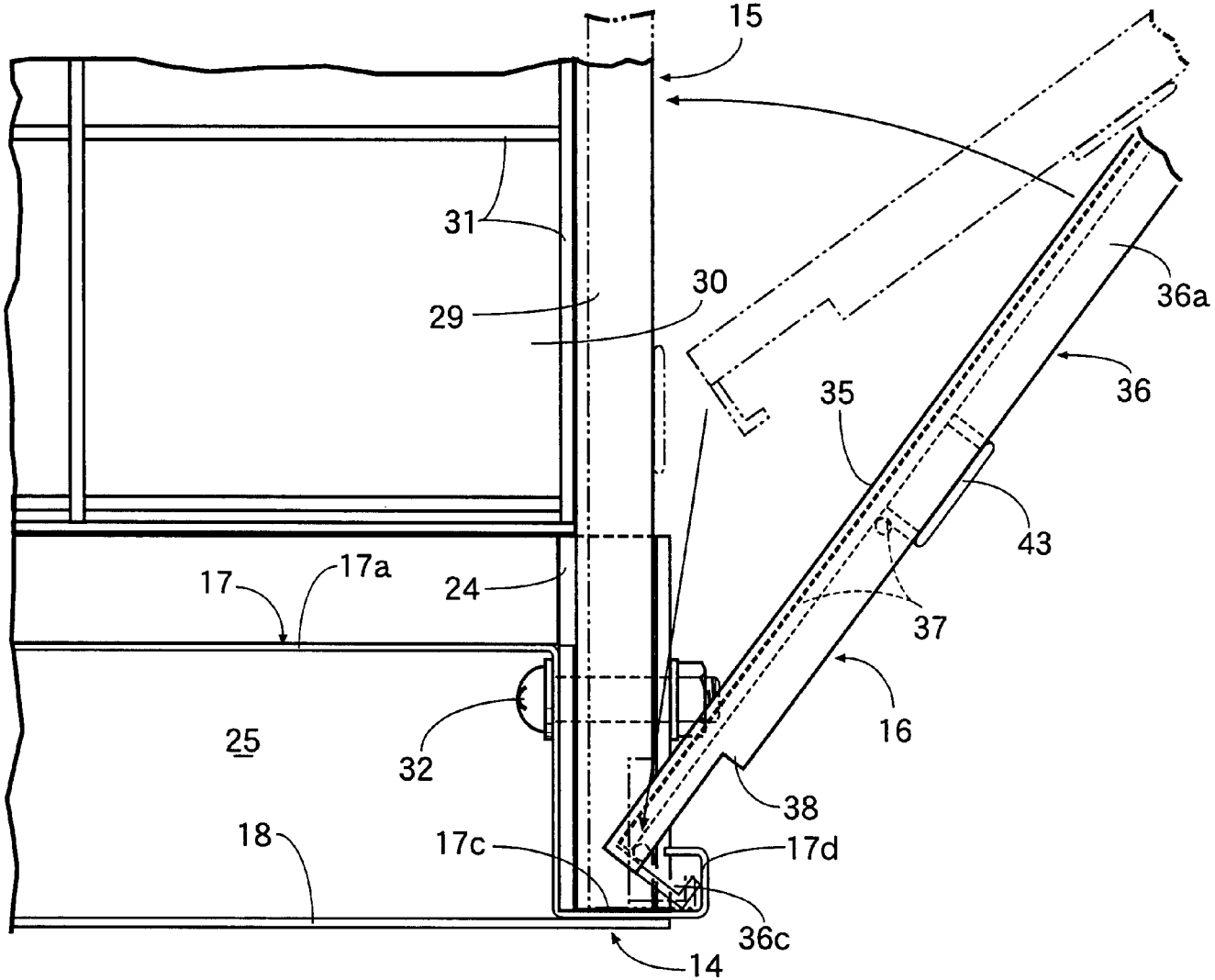

Moreover, the lower transverse plate portion 36*c* has a length such that it protrudes from the longitudinal plate portions 36*a*, 36*a*, when the sidewall 16 is viewed from sideways, as shown in FIG. 10. The lower transverse plate portion 36*c* is capable of being engaged with the locking portion 17*d* of the floor 14, as shown in FIG. 11.

Thus, the sidewall 16 is formed so that its lower end can be placed on the outer collar 17*c* between the main frame portion 17*a* and the locking portion 17*d* of the floor 14. When the sidewall 16 is raised up about a point at which the tip end of the lower transverse plate portion 36*c* is engaged with the locking portion 17*d*, from an attitude in which the sidewall 16 has been inclined in such a manner that the tip end of the lower transverse plate portion 36*c* has been brought into engagement with the locking portion 17*d*, the sidewall 16 stands up on the outer collar 17*c* in such a manner that its lower transverse plate portion 36*c* is engaged with the locking portion 17*d*.

Moreover, the shape and size of each of the sidewalls 16, 16 are determined so that the pair of sidewalls 16, 16 laminated on each other can be accommodated in the sidewall accommodating pocket 26 in the floor 14 upon folding-up of the sidewalls 16.

Opposite sides of the upper end of each sidewall 16 and opposite sides of the upper portion of the end wall 15 are connected to each other by connecting means 39 capable of disconnecting them. The connecting means 39 includes a connecting pin 40 mounted at the upper portion of the sidewall 16, and an engagement bore 42 provided in the upper portion of the end wall 15, so that the connecting pin 40 can be inserted through the engagement bore 42.

The connecting pin 40 is integrally provided at one end with an engagement portion 40*a* bent radially outwards, and an operating shaft 41 formed into a substantially L-shape is connected at right angle to an intermediate portion of the connecting pin 40. The connecting pin 40 is turnably and axially slidably supported by a support plate portion 35*a* integrally provided at the upper portion of the wall plate 35 so that it is opposed to the upper portion of the longitudinal plate portion 36*a* of the frame plate 36 from inside, and by the upper portion of the longitudinal plate portion 36*a*. An engagement bore 42 is provided in the upper portion of the support column 29 of the end wall 15, so that one end of the connecting pin 40 is inserted through the engagement bore 42. The engagement bore 42 is formed into an elongated shape in order to ensure that the engagement portion 40*a* can be inserted into and withdrawn from the engagement bore 42.

The wall plate 35 of the sidewall 16 is integrally provided at its upper portion with a clamping plate portion 35*b* for clamping a base portion of the operating shaft 41 between the clamping plate portion 35*b* and the support plate portion 35*a*, and a clamping plate portion 35*c* for clamping the base portion of the operating shaft 41 between the clamping plate portion 35*c* and the longitudinal plate portion 36*a*. When the connecting pin 40 is turned so that the engagement portion 40*a* inserted through the engagement bore 42 has been brought into engagement with the outer surface of the support column 29, the base portion of the operating shaft 41 is in a position in which it is sandwiched between the longitudinal plate portion 36*a* and the clamping plate portion 35*c*, and in this state, the upper portions of the sidewall 16 and the end wall 15 are connected to each other. To release the engagement of the engagement portion 40*a* with the support column 29, the operating shaft 41 may be turned so that it is moved away from a point between the longitudinal plate portion 36*a* and the clamping plate portion 35*c*. Further, the engagement portion 40*a* is moved to a position in which it can be engaged with the outer surface of the longitudinal plate portion 36*a*, by moving the operating shaft 41 to axially move the connecting pin 40 to a position corresponding to a point between the support plate portion 35*a* and the clamping plate portion 35*b*, and the engagement portion 40*a* can be maintained in a state in which it is in engagement with the outer surface of the longitudinal plate portion 36*a*, by turning the operating shaft 41 so that it is sandwiched between the support plate portion 35*a* and the clamping plate portion 35*b*.

Figure 12:
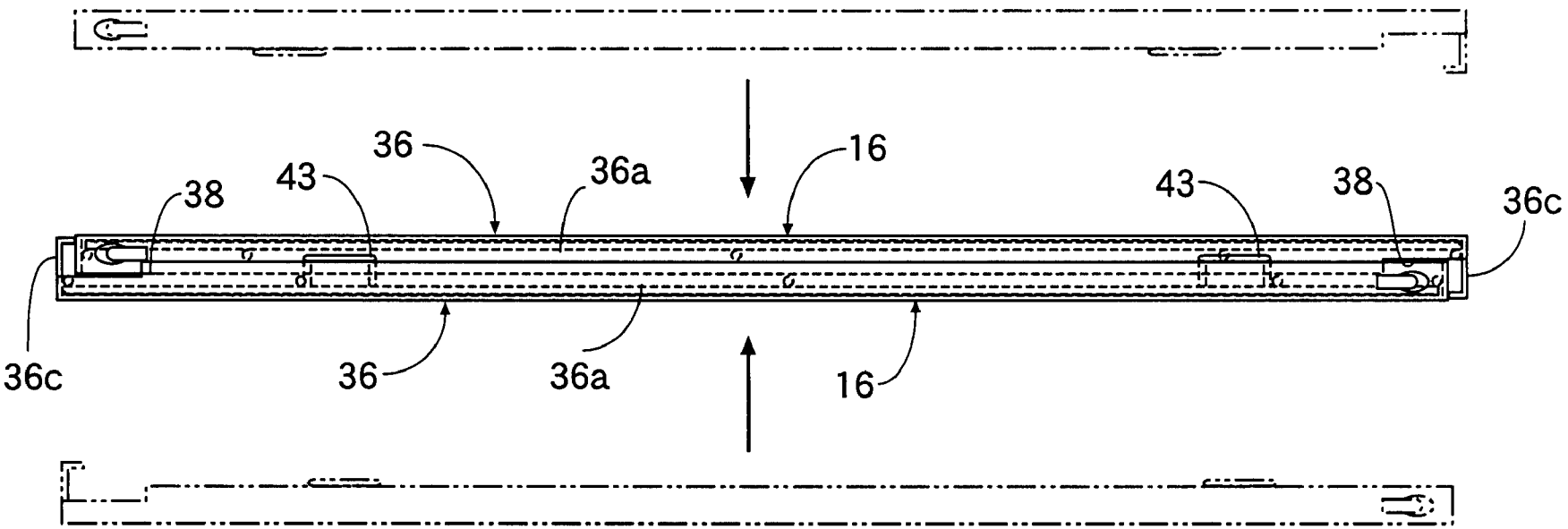
Figure 13:
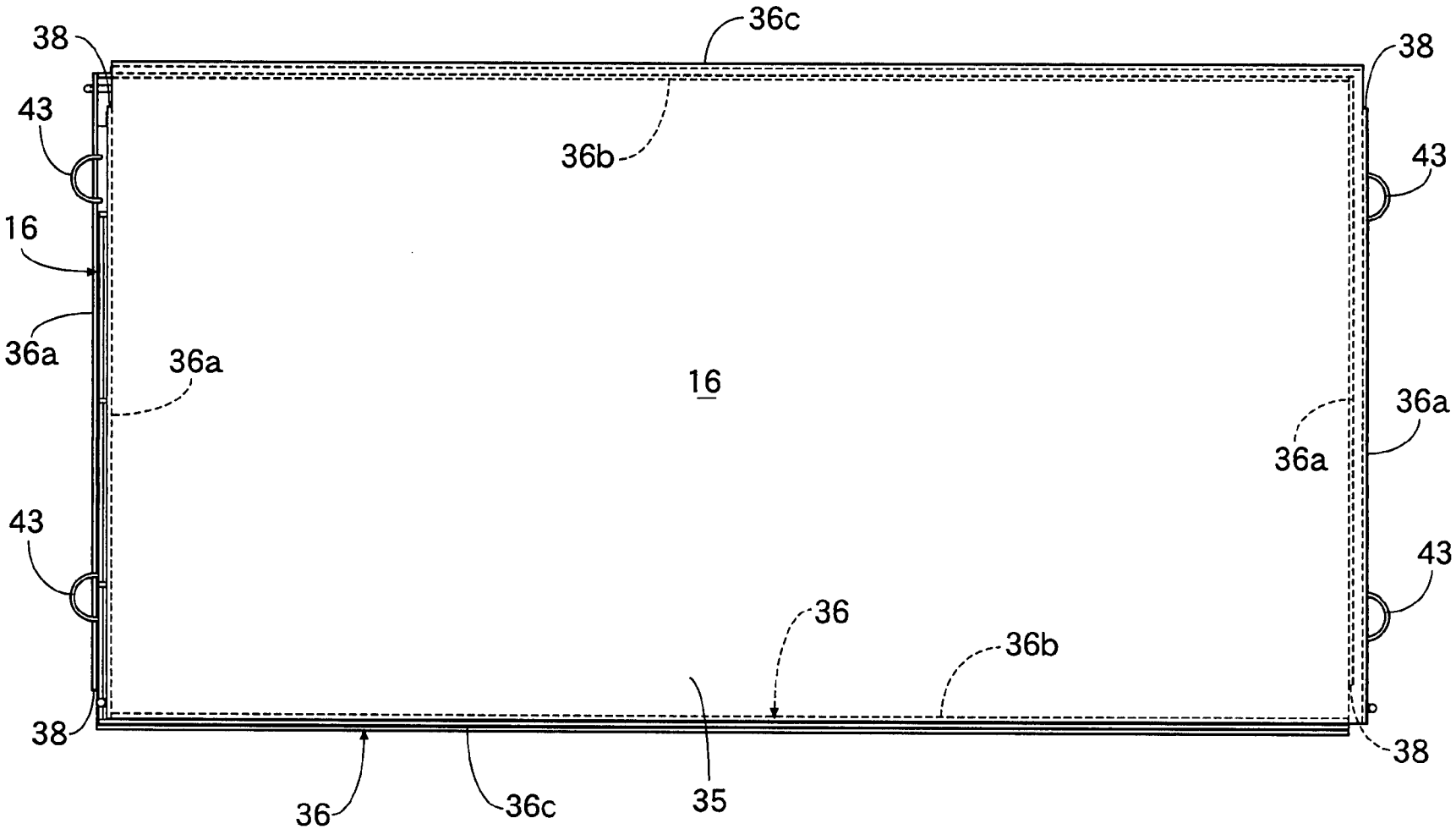

When the accommodating box has been folded up, the pair of sidewalls 16, 16 removed from the floor 14 and the pair of end walls 15, 15 are piled on each other, as shown in FIGS. 12 and 13. In this case, the sidewalls 16, 16 are piled on each other in a mutually embraced manner, so that their outer surfaces are opposed to each other and moreover, the notches 38 are located on opposite sides. Thus, the sidewalls 16, 16 are piled on each other, so that their frame plates 36, 36 partially adjoin each other on inner and outer sides.

Figure 14:
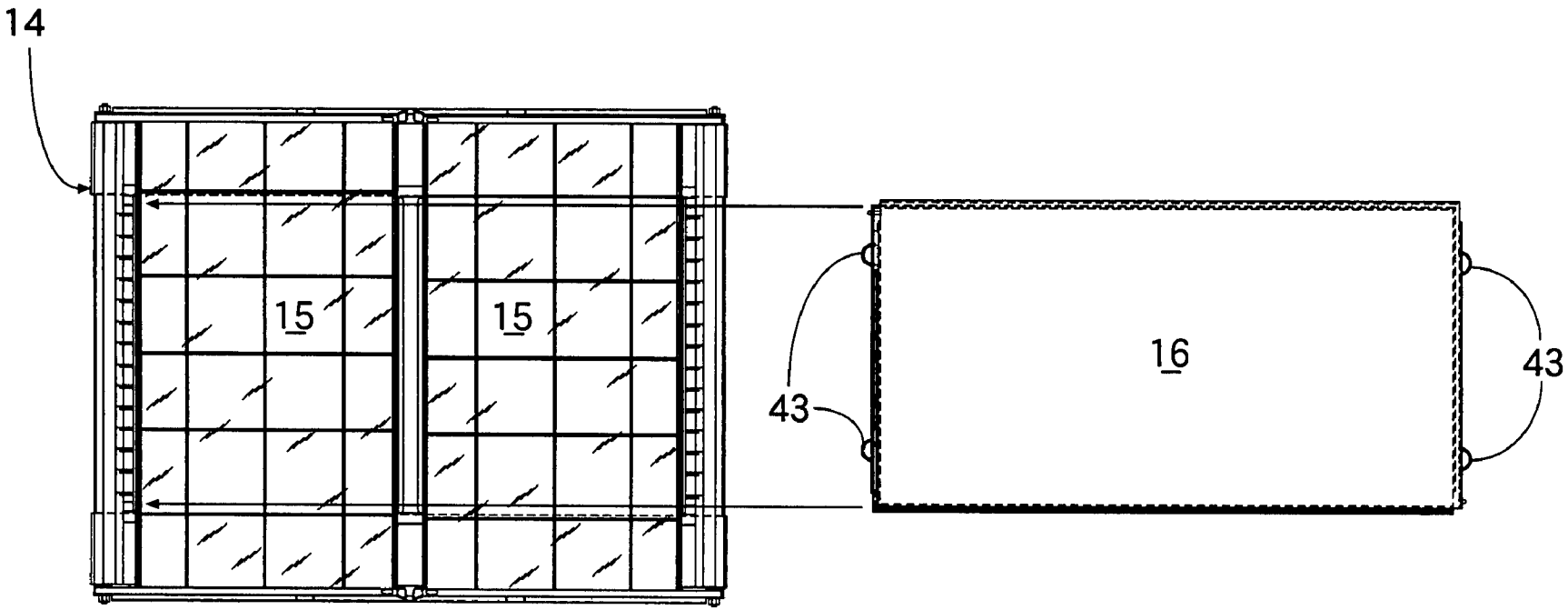
Figure 15:
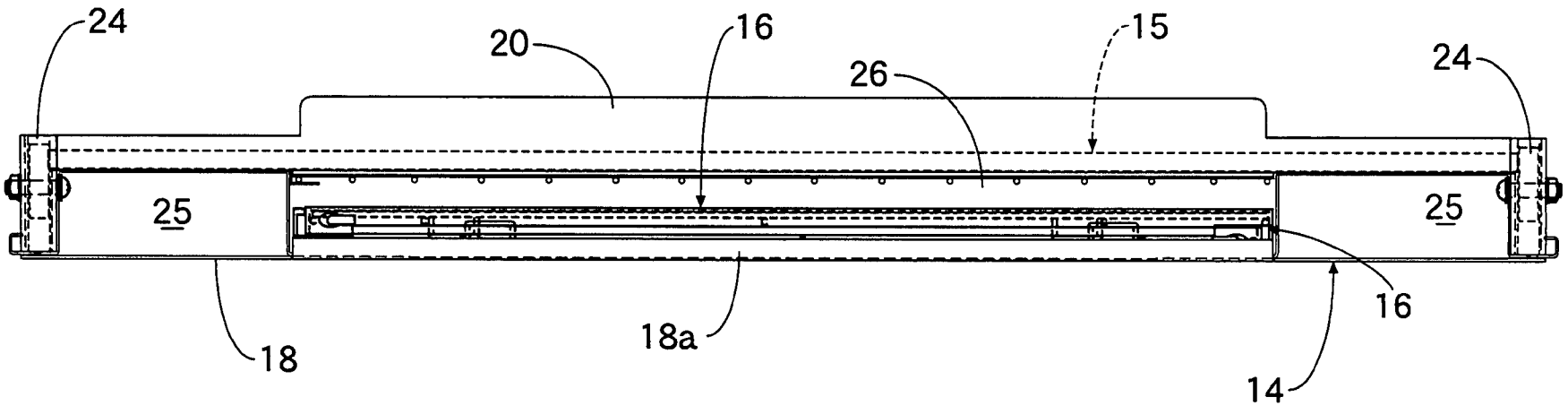

The pair of sidewalls 16, 16 piled on each other in the above manner are inserted into the sidewall accommodating pocket 26 in the floor 14, as shown in FIGS. 14 and 15. In order to facilitate this inserting operation and an operation for removing the sidewalls 16, 16 from the sidewall accommodating pocket 26, a pair of grips 43, 43 are secured to each of the sidewalls 16, 16. The entire accommodating box are brought into its folded-up state by accommodating the sidewalls 16, 16 in the sidewall accommodating pocket 26 and folding up the end walls 15, 15 onto the floor 14.

Figure 16:
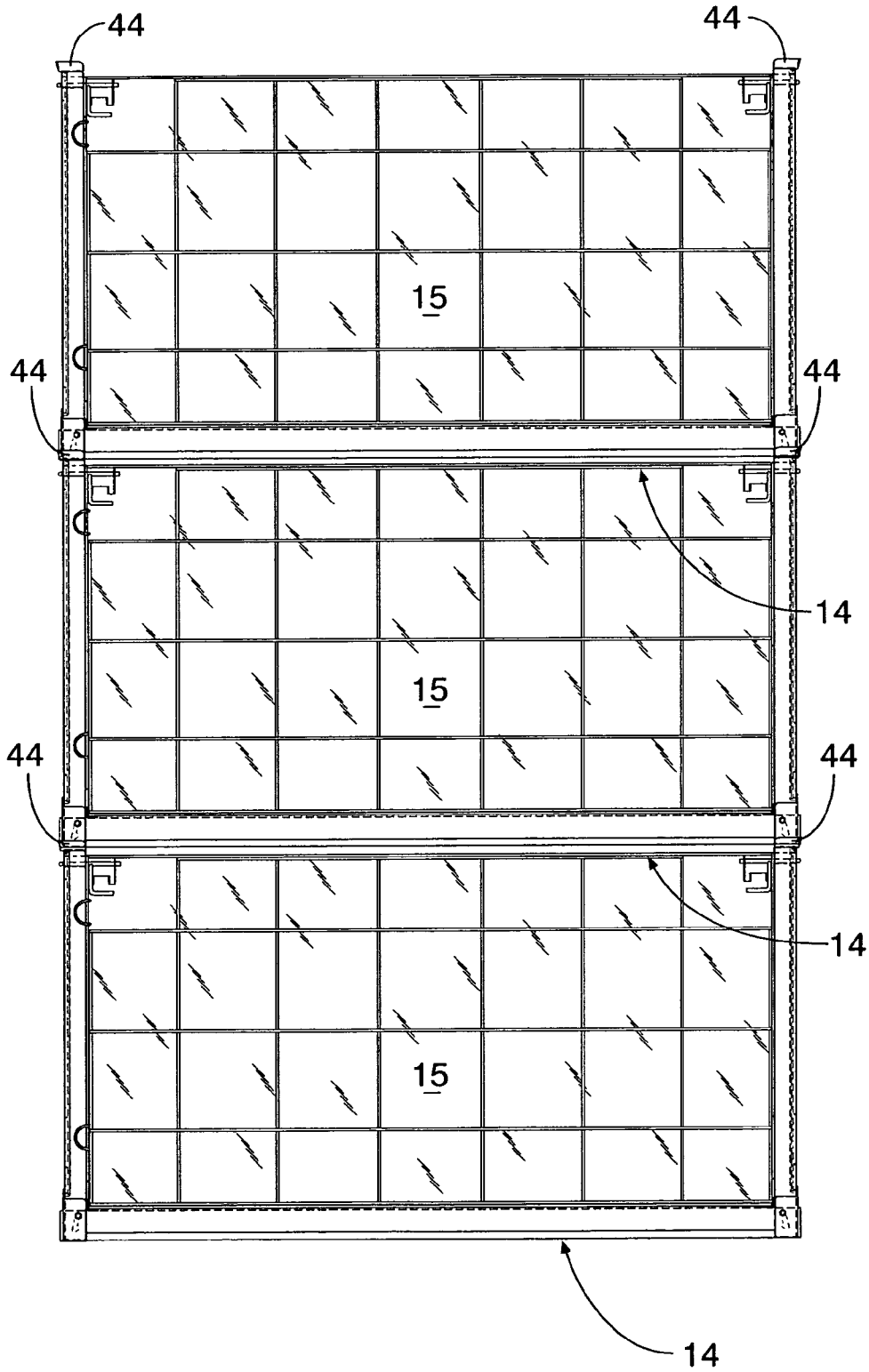

A plurality of accommodating boxes in their assembled states are stacked one on another, as shown in FIG. 16. During stacking of the accommodating boxes, receiving portions 44 for receiving four corners of the floor 14 of the overlying accommodating box are provided at the upper ends of the support columns 29 of each of the end walls 15.

The operation of the present embodiment will be described below. The foldable accommodating box includes the floor 14, the pair of end walls 15, 15 pivotally supported on the floor 14 for turning movement between the folded-up position in which they are piled on the floor 14 and the upright position in which they stand up from the floor 14, and the pair of sidewalls 16, 16 capable of being accommodated in the sidewall accommodating pocket 26 in the floor 14 in the mutually piled state. Each of the sidewalls 16 includes the wall plate 35 formed into the right-angled quadrilateral shape from the metal plate, a frame plate 36 formed into the right-angled quadrilateral piped shape and secured at right angle to the outer surface of the outer periphery of the wall plate 35, and the plurality of metal bars 37 which are secured to one another and combined in the lattice shape and which are secured to the wall plate 35 and the frame plate 36 on the side of the outer surface of the wall plate 35.

Therefore, by constructing most part of the sidewall 16 with the wall plate 35, it is possible to reliably prevent a portion of an accommodated member from protruding from the sidewall 16. In addition, even if the thickness of the wall plate 35 is set at a small value to the utmost, the wall plate 35 can be reinforced by the frame plate 36 and the plurality of metal bars 37 and hence, it is possible to provide the sidewall 16 with a sufficient strength, while avoiding an increase in weight of the sidewall 16.

Most part of the end wall 15 is also constituted by the end plate 30 and hence, it is possible to reliably prevent a portion of an accommodated member from protruding from the end wall 15. In addition, even if the thickness of the end plate 30 is set at a small value to the utmost, the end plate 30 can be reinforced by the support column 29 and the plurality of metal bars 31 and hence, it is possible to provide the end wall 15 with a sufficient strength, while avoiding an increase in weight of the end wall 15.

Moreover, the frame plate 36 of the sidewall 15 is provided with the notches 38, 38 for ensuring that when the pair of sidewalls 16, 16 are piled in the embraced manner on each other for accommodation in the sidewall accommodating pocket 26, so that their outer surfaces are opposed to each other, the frame plates 36 can be piled on each other to partially adjoin each other. Therefore, when the sidewalls 16, 16 are piled in the embraced manner on each other so that their outer surfaces have been opposed to each other, they are piled on each other with the frame plates 36, 36 partially adjoining each other on inner and outer sides. Therefore, it is possible to prevent the thickness of the sidewalls 16, 16 in their piled states from being increased and in its turn, to contribute to a reduction in thickness of the floor 14.

The floor 14 includes the end upper surface connecting members 20 which each have the protruding wall 20*a* opposed to the lower portion of the end wall 15 in the upright state from outside and which connect the upper surfaces of the opposed ends of the frames 17, 17 to each other, and the end lower surface connecting members 18 which connect the lower surfaces of the opposed ends of the frames 17, 17 inside the protruding walls 20*a*. The notches 20*b*, 20*b* are formed on the opposite sides of each of the protruding walls 20*a*, so that when the plurality of floors 14 have been stacked one on another with the ends 15 folded up, the ends of the frames 17, 17 of the overlying floor 14 are disposed in the notches 20*b*, 20*b*. The limiting wall 18*a* is projectingly provided on each of the end lower surface connecting members 18 and adapted to be opposed to the protruding wall 20*a* of the underlying floor 14 from inside, when the plurality of floors 14 have been stacked one on another with the end walls 15 folded up.

With such structure of the floor 14, the floors 14 with the end walls 15 folded up can be stacked one on another, because the notches 20*b*, 20*b* are formed on the opposite sides of each of the protruding walls 20*a*, and each of the end lower surface connecting members 18 is inside the protruding wall 20*a* of each of the end upper surface connecting members 20.

In addition, when the accommodating box has been assembled, the protruding wall 20*a* is opposed to the lower portion of the end wall 15 from outside, whereby the occurrence of the outward falling of the end wall 15 can be prevented. When the accommodating boxes in the folded-up states have been stacked one on another, the limiting wall 18*a* of the overlying accommodating box is opposed to the protruding wall 20*a* of the overlying accommodating box from inside, whereby the occurrence of the offsetting of the accommodating boxes from each other in the lengthwise direction of the frames 17, 17 can be prevented.

Although the embodiment of the present invention has been described in detail, it will be understood that the present invention is not limited to the above-described embodiments, and various modifications in design may be made without departing from the spirit and scope of the invention defined in the claims.

What is claimed is:

1. A foldable accommodating box comprising a floor which includes a pair of parallel frames each forming a fork pocket and connected to each other, and a sidewall accommodating pocket formed between said frames; a pair of end walls pivotally supported on said floor for turning movement between a folded-up position in which they are piled on said floor and an upright position in which they stand up from said floor; and a pair of sidewalls capable of being accommodated in said sidewall accommodating pocket in a mutually piled state, so that when said accommodating box has been assembled, said pair of end walls opposed to each other and said pair of sidewalls opposed to each other perpendicularly to the end walls are provided to rise on the floor to form a rectangular parallelepiped shape, wherein each of said sidewalls includes a wall plate formed from a metal plate into a right-angled quadrilateral shape, a frame plate formed from a metal plate into a right-angled quadrilateral piped shape and secured at right angles to an outer surface of an outer periphery of said wall plate, and a plurality of metal bars which are secured to one another and combined into a lattice shape and which are secured to said wall plate and said frame plate on the side of the outer surface of said wall plate, said frame plate being provided with notches ensuring that when said sidewalls are piled on each other in an embraced manner so that their outer surface are opposed to each other, they are piled on each other with said frame plates partially adjoining each other on inner and outer sides.

2. A foldable accommodating box according to claim 1, wherein said floor includes end upper surface connecting members which each have a protruding wall opposed to a lower portion of said end wall in an upright state from outside and which connect upper surfaces of opposed ends of both said frames, and end lower surface connecting members which connect lower surfaces of the opposed ends of both said frames inside said protruding wall; said protruding wall having notches provided on opposite sides thereof for ensuring that when a plurality of the floors are stacked one on another with said end walls folded up, the ends of the frames of the overlying floor are disposed in said notches; and each of said end lower surface connecting members is projectingly provided with a limiting wall which is adapted to be opposed to said protruding wall of the underlying floor from inside, when the plurality of the floors are stacked one on another with said end walls folded up.

* * * * *